US009677711B2

(12) United States Patent
Boyeau et al.

(10) Patent No.: US 9,677,711 B2
(45) Date of Patent: Jun. 13, 2017

(54) SEALED AND THERMALLY INSULATING TANK FOR STORING A FLUID

(71) Applicant: Gaztransport Et Technigaz, Saint Remy-les-Chevreuse (FR)

(72) Inventors: Marc Boyeau, Viroflay (FR); Sebastien Delanoe, Gif-sur-Yvette (FR); Johan Bougault, Jouy-en-Josas (FR)

(73) Assignee: Gaztransport Et Technigaz, Saint Remy les Chevreuse (FR)

( * ) Notice: Subject to any disclaimer, the term of this patent is extended or adjusted under 35 U.S.C. 154(b) by 60 days.

(21) Appl. No.: 14/783,773

(22) PCT Filed: Apr. 3, 2014

(86) PCT No.: PCT/FR2014/050792

§ 371 (c)(1),
(2) Date: Oct. 9, 2015

(87) PCT Pub. No.: WO2014/167213

PCT Pub. Date: Oct. 16, 2014

(65) Prior Publication Data

US 2016/0252211 A1 Sep. 1, 2016

(30) Foreign Application Priority Data

Apr. 12, 2013 (FR) ..... 13 53324

(51) Int. Cl.
*F17C 3/02* (2006.01)
*B63B 25/16* (2006.01)
(Continued)

(52) U.S. Cl.
CPC ..... *F17C 3/027* (2013.01); *B63B 25/16* (2013.01); *B63B 27/25* (2013.01); *F17C 3/06* (2013.01);
(Continued)

(58) Field of Classification Search
CPC ..... F17C 3/027; F17C 3/06; F17C 2209/221; F17C 2209/227; F17C 2209/228;
(Continued)

(56) References Cited

U.S. PATENT DOCUMENTS 3,547,302 A * 12/1970 Massac ..... B63B 25/16 114/74 A
3,800,970 A * 4/1974 Jackson ..... B65D 90/023 220/560.08
(Continued)

FOREIGN PATENT DOCUMENTS

FR 2321657 A1 3/1977
FR 2739675 A1 4/1997
(Continued)

OTHER PUBLICATIONS

International Search Report and Written Opinion, PCT Application No. PCT/FR2014/050792; dated Sep. 24, 2015, 10 pages.

*Primary Examiner* — Nicholas A Arnett

(57) ABSTRACT

The disclosure relates to a sealed and thermally insulating tank for storing a fluid, said sealed tank comprising an outer support structure, a thermal insulating barrier retained on the support structure, and a sealing barrier supported by the thermal insulating barrier. In one embodiment, the thermal insulating barrier comprises a corner structure positioned at an intersection between a first and a second wall of the support structure, the corner structure comprising a first and a second insulating panel, each having an outer surface positioned facing the support structure, an inner surface provided with a member for securing the sealing membrane, and lateral edges, the first panel having an outer surface resting against the first wall of the support structure and a lateral edge resting against the second wall of the support structure, the second panel having an outer surface resting
(Continued)

against the second wall of the support structure and a lateral edge resting against the outer surface of the first panel.

19 Claims, 7 Drawing Sheets

(51) Int. Cl.
*B63B 27/24* (2006.01)
*B63B 27/25* (2006.01)
*F17C 3/06* (2006.01)

(52) U.S. Cl.
CPC *F17C 2201/0157* (2013.01); *F17C 2201/052* (2013.01); *F17C 2203/0333* (2013.01); *F17C 2203/0354* (2013.01); *F17C 2203/0358* (2013.01); *F17C 2203/0631* (2013.01); *F17C 2203/0643* (2013.01); *F17C 2203/0646* (2013.01); *F17C 2203/0651* (2013.01); *F17C 2209/221* (2013.01); *F17C 2209/227* (2013.01); *F17C 2209/228* (2013.01); *F17C 2221/033* (2013.01); *F17C 2223/0161* (2013.01); *F17C 2223/033* (2013.01); *F17C 2260/013* (2013.01); *F17C 2270/0107* (2013.01)

(58) Field of Classification Search
CPC ..... F17C 2201/052; F17C 2201/0157; F17C 2260/013; F17C 2270/0107; F17C 2203/0333; F17C 2203/0631; F17C 2203/0643; F17C 2203/0354; F17C 2203/0646; F17C 2203/0358; F17C 2223/033; F17C 2223/0161; F17C 221/033; B63B 27/25; B63B 25/16
USPC ..... 220/560.04, 560.08, 560.11, 560.12; 141/1, 82, 231; 137/236.1
See application file for complete search history.

(56) References Cited

U.S. PATENT DOCUMENTS 3,998,350 A * 12/1976 Massac ..... B63B 25/16 220/560.08
4,021,982 A * 5/1977 Kotcharian ..... F16L 59/02 220/592.26
4,023,726 A * 5/1977 Massac ..... B63B 25/16 228/184
4,065,019 A 12/1977 Letourneur et al.
4,116,150 A * 9/1978 McCown ..... B63B 25/16 114/74 A
4,155,482 A * 5/1979 Swaney ..... B63B 25/16 220/560.11
4,170,952 A * 10/1979 McCown ..... B63B 25/16 114/74 A
4,452,162 A * 6/1984 Harbaugh ..... B63B 25/16 114/74 A
6,626,319 B2 * 9/2003 Miller ..... B65D 88/16 220/1.5
7,171,916 B2 * 2/2007 Yang ..... B63B 3/68 114/74 A
7,204,195 B2 * 4/2007 Yang ..... B63B 25/14 114/74 A
7,325,288 B2 * 2/2008 Yang ..... B63B 3/68 220/560.07
7,469,650 B2 * 12/2008 Jordan ..... B63B 25/16 114/74 A
7,597,212 B2 * 10/2009 Yang ..... B63B 3/68 220/560.06
7,717,288 B2 * 5/2010 Yang ..... B63B 3/68 220/560.05
7,748,336 B2 * 7/2010 Jordan ..... B63B 25/16 114/74 A
7,819,273 B2 * 10/2010 Yang ..... F17C 13/001 220/560.07
7,896,188 B2 * 3/2011 Jordan ..... F17C 3/022 220/23.2
8,430,263 B2 * 4/2013 Jordan ..... F17C 3/022 114/74 A
8,857,650 B2 * 10/2014 Skovholt ..... F17C 3/022 220/560.04
9,022,245 B2 * 5/2015 Jordan ..... F17C 3/022 220/560.05
9,360,159 B2 * 6/2016 Gazeau ..... F17C 3/027
9,440,712 B2 * 9/2016 Bougault ..... F17C 3/027
9,518,700 B2 * 12/2016 Herry ..... F17C 3/027
2006/0117566 A1 6/2006 Yang et al.
2007/0181586 A1 * 8/2007 Van Ootmarsum ..... F17C 3/022 220/592.26
2015/0167894 A1 * 6/2015 Gazeau ..... F17C 3/027 114/74 A
2015/0285439 A1 * 10/2015 Herry ..... F17C 3/027 114/74 A
2015/0354756 A1 * 12/2015 Philippe ..... B63B 3/68 114/74 A
2015/0369428 A1 * 12/2015 Ducoup ..... F17C 3/027 62/53.2
2015/0375830 A1 * 12/2015 Bougault ..... F17C 3/027 114/74 A
2016/0069514 A1 * 3/2016 Delanoe ..... F17C 3/027 137/1
2016/0200402 A1 * 7/2016 Boyeau ..... F17C 3/027 114/74 A
2016/0252210 A1 * 9/2016 Bougault ..... F17C 3/027 141/1

FOREIGN PATENT DOCUMENTS

WO 2014167213 A2 10/2014
WO 2014167213 A3 10/2014

* cited by examiner

SEALED AND THERMALLY INSULATING TANK FOR STORING A FLUID

CROSS-REFERENCE TO RELATED APPLICATION

This application is the National Stage of, and therefore claims the benefit of, International Application No. PCT/FR2014/050792 filed on Apr. 3, 2014, entitled "SEALED AND THERMALLY INSULATING TANK FOR STORING A FLUID," which was published in French under International Publication Number WO 2014/167213 on Oct. 16, 2014. International Application No. PCT/FR2014/050792 claims priority to FR Application No. 1353324 filed on Apr. 12, 2013. Both of the above applications are commonly assigned with this National Stage application and are incorporated herein by reference in their entirety.

TECHNICAL FIELD

The disclosure relates to the field of sealed and thermally insulating membrane tanks for the storage and/or transportation of fluid such as a cryogenic fluid.

Sealed and thermally insulating membrane tanks are used, notably, for the storage of liquefied natural gas (LNG), which is stored at atmospheric pressure at about −162° C. These tanks may be installed on the land or on a floating structure. In the case of a floating structure, the tank may be intended for the transportation of liquefied natural gas or for receiving liquefied natural gas used as fuel for the propulsion of the floating structure.

BACKGROUND

The document FR 2 691 520 describes a sealed and thermally insulating tank having, in succession, through the thickness, from the inside toward the outside of the tank, a primary sealing membrane in contact with the fluid contained in the tank, a primary thermal insulating barrier, a secondary sealing membrane, a secondary thermal insulating barrier, and a support structure consisting of metal plates forming the hull or the double hull of a merchant ship such as a gas carrier. The corner areas of the tank are made from a pre-assembled corner structure of dihedral form, shown in FIG. 3 of document FR 2 691 520.

A pre-assembled corner structure comprises two beveled insulating plates joined by means of a corner joint and forming the secondary insulating barrier, a flexible membrane resting against the insulating plates of the secondary insulating barrier and forming the secondary sealing barrier, and two other beveled insulating plates, joined by means of a corner joint and forming the primary insulating barrier. This corner structure is advantageous in that it enables the corner structures to be pre-assembled in the workshop. However, these corner structures are heavy and bulky, making them difficult to transport and handle. The manufacture of these structures is also relatively complicated.

SUMMARY

An idea on which the disclosure is based is that of providing a sealed and thermally insulating tank in which the corner structure is particularly simple to produce.

According to one embodiment, the disclosure provides a sealed and thermally insulating tank for storing a fluid, said sealed tank comprising an outer support structure, a thermal insulating barrier retained on the support structure, and a sealing membrane comprising corrugations extending in two perpendicular directions and supported by the thermal insulating barrier, the thermal insulating barrier comprising a corner structure positioned at an intersection between a first and a second wall of the support structure, said corner structure comprising a first and a second insulating panel, each having an outer surface positioned facing the support structure, an inner surface provided with a member for securing the sealing membrane, and lateral edges, the first panel having an outer surface resting against the first wall of the support structure and a lateral edge resting against the second wall of the support structure, and the second panel having an outer surface resting against the second wall of the support structure and a lateral edge resting against the inner surface of the first panel.

Thus the corner structure of the thermal insulating barrier comprises two easily transportable panels. Furthermore, the manufacture of this corner structure is simplified.

According to embodiments, this sealed and thermally insulating tank may have one or more of the following characteristics.

The first and second panels each comprise an inner plywood sheet and an outer plywood sheet, forming the inner surface and the outer surface, respectively, of said first and second panels, and a layer of insulating polymer foam sandwiched between said inner and outer plywood sheets.

The lateral edge of the first panel, resting against the second wall, may be provided with a plywood sheet.

The outer surface of the first panel resting against the first wall, the lateral edge of the first panel resting against the second wall, and the outer surface of the second panel resting against the second wall are glued to the support structure.

The first and second panels each comprise, on their inner surface, a member for securing the sealing membrane, comprising a metal connecting strip extending along an axis parallel to the intersection between the first and the second wall, said sealing membrane comprising metal plates extending on either side of said corner structure and an angle piece extending between a metal connecting strip of the first panel and a metal connecting strip of the second panel, the metal plates having edges welded to the metal connecting strips or to the angle piece, said angle piece having edges welded to the edges of the metal plates welded to said metal connecting strips, or to the metal connecting strips.

A metal connecting strip may be retained in a recess formed on the inner surface of the first or second panel, and may be fitted in said recess with a sliding clearance j in a direction transverse to the direction of said metal connecting strip, so as to allow the metal connecting strip to move in the plane of the first or the second panel respectively.

The thermal insulating barrier may be a secondary thermal insulating barrier, and the sealing membrane may be a secondary sealing membrane, the tank further comprising a primary thermal insulating barrier and a primary sealing membrane.

The first and second panels are fitted with pins for fastening the primary thermal insulating barrier, these pins projecting inward from the inner surfaces of said first and second panels.

The pins for fastening the primary thermal insulating barrier extend in the axis of one of the metal connecting strips, and the edges of the metal plates welded to the metal connecting strips and/or to the angle piece and the edges of the angle piece welded to the metal connecting strips and/or to edges of the metal plates welded to said metal connecting strips are provided with cut-outs for the passage of the pins for fastening the primary thermal insulating barrier.

The primary thermal insulating barrier comprises, at the intersection between the first and the second wall of the support structure, a corner structure comprising a first and a second primary thermal insulating panel, each having an outer surface positioned facing the secondary sealing membrane, an inner surface provided with a member for securing the primary sealing membrane, and lateral edges, the first primary thermal insulating panel having a lateral edge resting against the second sealing membrane, and the second primary thermal insulating panel having a lateral edge resting against the inner surface of the first primary thermal insulating panel.

The angle formed between the first and the second wall may be 90°.

The first wall may be a horizontal wall and the second wall may be a vertical wall.

A tank of this type may form part of a land-based storage installation, for LNG storage for example, or may be installed in a floating structure in coastal or deep waters, notably in a gas carrier ship, a floating storage and regasification unit (FSRU), a floating production and storage and offloading unit (FPSO), or others.

According to one embodiment, a ship for transporting a fluid comprises a double hull and a tank of the aforesaid type, with the double hull forming the outer support structure of the tank.

According to one embodiment, the disclosure also provides a method for loading or unloading a ship of this type, in which a fluid may be conveyed through insulated pipes from or toward a floating or land-based storage installation toward or from the ship's tank.

According to one embodiment, the disclosure also provides a transfer system for a fluid, the system comprising the aforesaid ship, insulated pipes arranged so as to connect the tank installed in the ship's hull to a floating or land-based storage installation and a pump for propelling a flow of fluid through the insulated pipes from or toward the floating or land-based storage installation toward or from the ship's tank.

BRIEF DESCRIPTION OF THE DRAWINGS

The disclosure will be better understood and other objects, details, characteristics and advantages thereof will be more fully apparent from the following description of some specific embodiments of the disclosure, provided solely for illustrative purposes and in a non-limiting way, with reference to the attached drawings.

DETAILED DESCRIPTION

Conventionally, the terms "outer" and "inner" are used to define the relative position of one element with respect to another, with reference to the inside and outside of the tank.

Figure 1:
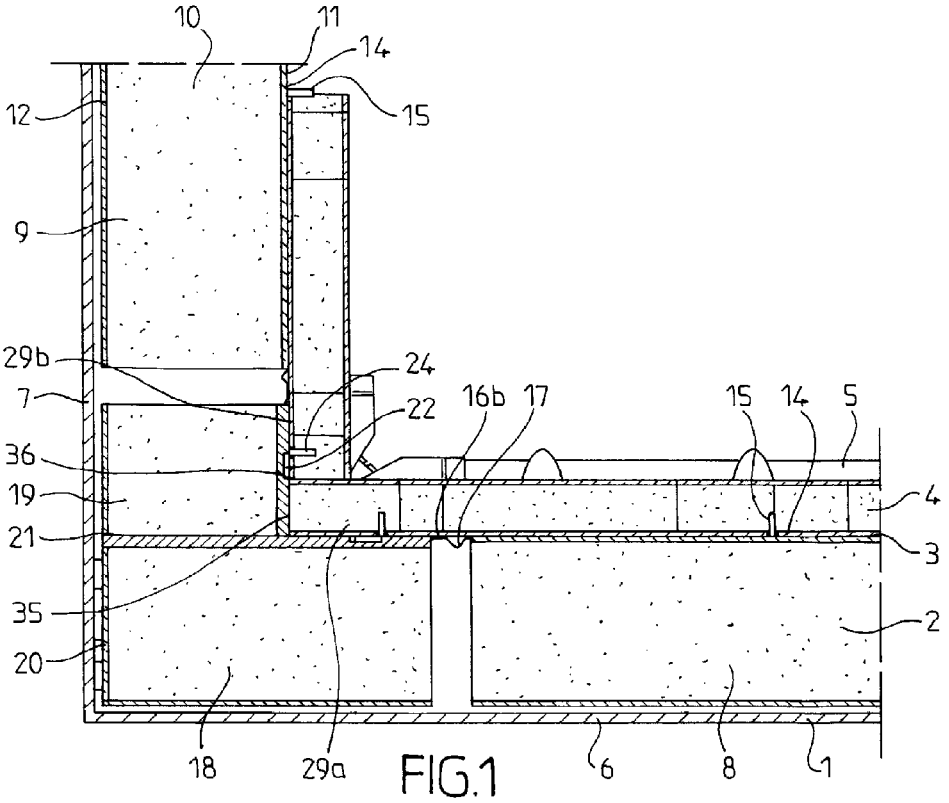
FIG. 1 is a sectional view of a sealed and thermally insulating tank, comprising two sealing membranes and two thermal insulating barriers, in a corner area.

With reference to FIG. 1, this shows a sealed and thermally insulating tank structure having, from the outside toward the inside of the tank, a support structure 1, a secondary thermal insulating barrier 2, a secondary sealing membrane 3, a primary thermal insulating barrier 4 and a primary sealing membrane 5 designed to be in contact with the cryogenic fluid contained in the tank.

The support structure 1 can, notably, be a self-supporting metal sheet, or, more generally, any type of rigid partition having appropriate mechanical properties. The support structure 1 can, notably, be formed by the hull or the double hull of a ship. The support structure 1 comprises a plurality of walls defining the general shape of the tank.

In the corner area shown in FIG. 1, the support structure 1 comprises a first wall 6 forming the bottom of the tank and a second wall 7 forming a vertical partition in the tank.

The secondary thermal insulating barrier 2 comprises a plurality of insulating blocks 8, 9 arranged on the surfaces of the walls 6, 7 of the support structure 1 and secured to said support structure 1 by means of resin pads (not shown) and/or pins welded to the support structure 1 (not shown).

Figure 2:
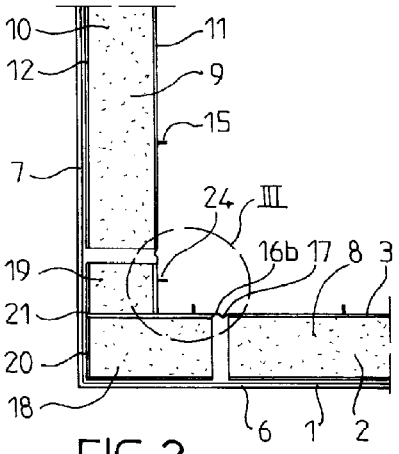
FIG. 2 is a sectional view showing a secondary thermal insulating barrier in a corner area.

In FIGS. 1 and 2, it can be seen that the insulating blocks 8 and 9 comprise a layer of insulating polymer foam 10 sandwiched between a rigid inner plate 11 and a rigid outer plate 12. The rigid inner plates 11 and outer plates 12 are, for example, plywood sheets glued to said layer of foam 10. The insulating polymer foam may, notably, be a polyurethane foam which may have a high density and may be reinforced with glass fibers if necessary.

Figure 5:
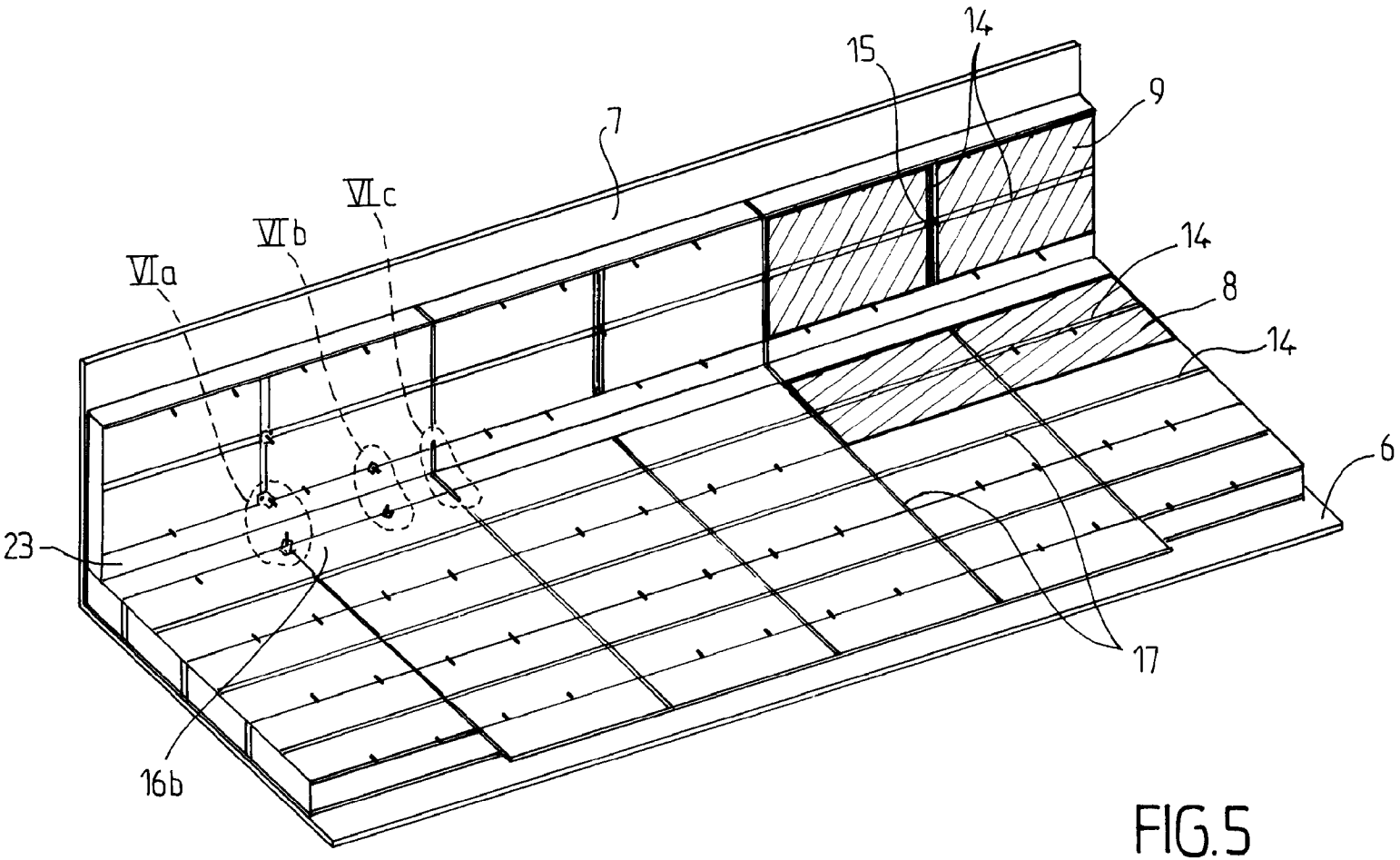
FIG. 5 is a partially cut-away perspective view of a secondary sealing barrier and a secondary thermal insulating barrier.

Two insulating blocks 8, 9 are hatched in the perspective illustration of FIG. 5. The insulating blocks 8, 9 have a substantially rectangular parallelepiped shape. The insulation blocks 8, 9 have a metal connecting strip 14 along their two axes of symmetry, this strip being placed in a recess and being fastened therein with screws, rivets, staples or adhesive. In the area of intersection of the metal connecting strips 14, a pin 15 is provided, this pin projecting inward for the fastening of the primary thermal insulating barrier 4.

The secondary sealing membrane 3 is formed by assembling a plurality of metal plates 16*a*, 16*b* welded edge to edge and having a substantially rectangular shape. Outside the corner area, the metal plates 16*a* comprise, along each of the two axes of symmetry of this rectangle, a corrugation 17 forming a relief projection in the direction of the support structure 1. In this case, the metal plates 16*a* are positioned in a staggered manner relative to the insulation blocks 8, 9, so that each of said metal plates 16*a* extends across four adjacent insulation blocks 8, 9. Additionally, the corrugations 17 form a relief projection in the direction of the support structure 1 and are housed in interstices of the secondary thermal insulating barrier 2 formed between two adjacent insulation blocks 8, 9. The adjacent metal plates 16*a* are lap welded to one another. The metal plates 16*a* are held on the insulation blocks 8, 9 by means of the metal connecting strips 14, to which at least two edges of said metal plates 16*a* are welded.

At the wall edge, the secondary sealing membrane 3 comprises metal plates 16*b* which join the secondary sealing membrane 3 to the corner structure, these metal plates having widths which may differ from that of the other metal plates 16*a*, so as to be adapted to the dimensions of the corner structure. The metal plates 16*b* are also provided with two perpendicular corrugations 17 forming a relief projection in the direction of the support structure 1 and extending, respectively, in an interstice 13 between the insulation blocks 8, 9 and the panels 18, 19 forming the corner structure of the secondary thermal insulating barrier 2 and in an interstice between two adjacent insulation blocks 8, 9.

The metal plates 16*a*, 16*b* of the secondary sealing membrane 3 are, for example, made of Invar®, an alloy of iron and nickel whose coefficient of expansion is typically in the range from $1.5\times10^{-6}$ to $2\times10^{-6}$ $K^{-1}$.

Figure 4:
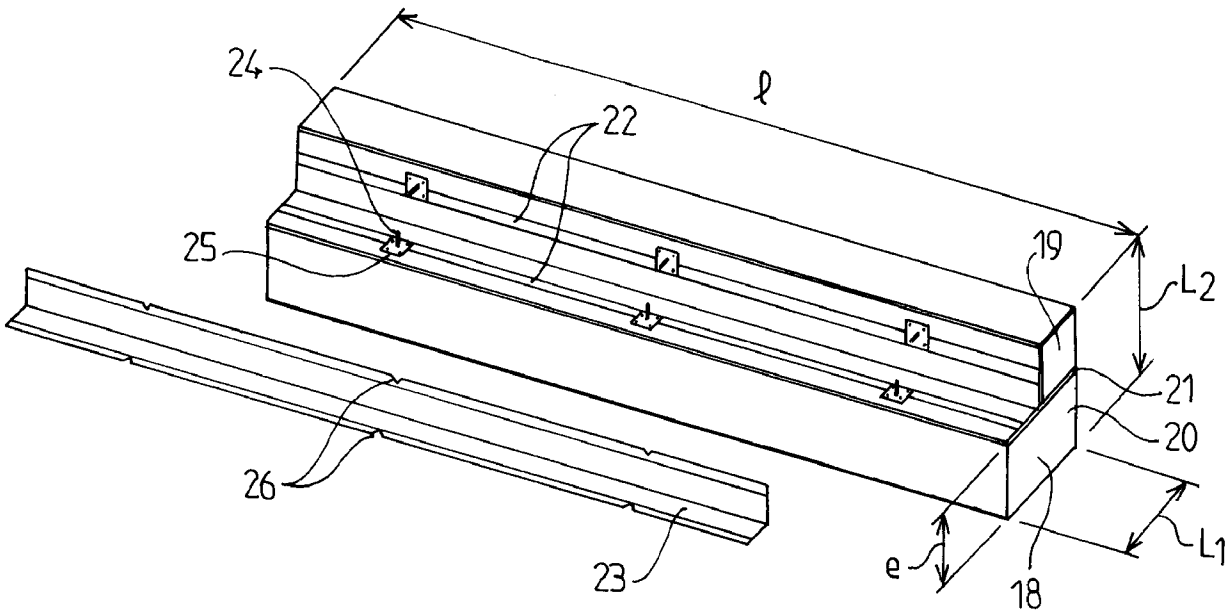
FIG. 4 is a perspective view of a corner structure of a secondary thermal insulating barrier and an angle piece designed to be applied to said corner structure.

With reference to FIGS. 1, 2 and 4, these show the corner structure of the secondary thermal insulating barrier 2. Said corner structure comprises insulating panels 18, 19, which are, respectively, horizontal and vertical, and are of rectangular parallelepiped shape. In a similar way to the insulation blocks 8, 9 described above, the panels 18, 19 of the corner structure comprise a layer of insulating polymer foam sandwiched between two rigid plates, namely an inner and an outer plate, made of plywood for example, glued to said foam layer.

When the tank is assembled, a horizontal panel 18 is positioned horizontally against the support structure 1 so that its outer surface rests against the first wall 6 and one of its lateral edges 20 rests against the second wall 7. The angle formed between the outer surface of a horizontal panel 18 and its lateral edge 20 is therefore equal to the angle formed at the intersection between the walls 6, 7, that is to say 90° in the illustrated embodiment. A horizontal panel 18 is fastened to the support structure 1, for example by gluing the outer surface of said panel 18, and optionally its lateral edge 20, to the horizontal wall 6 and to the vertical wall 7 respectively.

In the illustrated embodiment, the lateral edge 20 of a horizontal panel 18, resting against the vertical wall 7, is provided with a plywood sheet. This plywood sheet can facilitate the positioning of the panel 18 and/or improve the effectiveness of the gluing of the lateral edge 20 of the panel 18 to the vertical wall 7 of the support structure 1 when said lateral edge 20 is glued to the support structure 1.

A vertical panel 19 is then positioned against the support structure 1 so that its outer surface rests against the wall 7 and its lower lateral edge 21 rests against the inner surface of the horizontal panel 18. The angle formed between the lower lateral edge 21 of the vertical panel 19 and its outer surface is therefore equal to the angle formed between the wall 7 of the support structure 1 and the inner surface of the first panel 18, that is to say 90° in the illustrated embodiment. The second panel 19 is fastened to the support structure 1 by gluing its outer surface to the wall 7.

The panels 18 and 19 also have metal connecting strips 22 on their inner surfaces. These metal connecting strips 22 extend along an axis parallel to the corner formed at the intersection between the walls 6, 7. The metal connecting strips 22 serve to secure metal plates 16*b* which join the secondary sealing membrane 3 to the corner structure.

Figure 3:
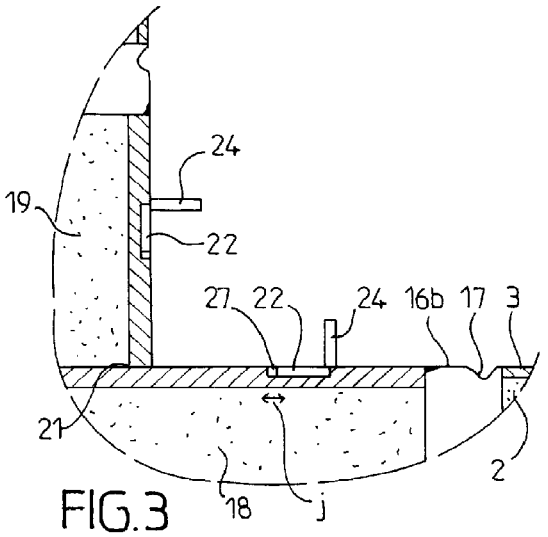
FIG. 3 is a detailed view of area III of FIG. 2.

In one embodiment, the metal connecting strips 22 are retained in a recess 27, shown in FIG. 3, which is formed in the inner rigid plate of the panels 18, 19. According to one embodiment, the metal connecting strips 22 are fastened to the inner rigid plate of the panels 18, 19 by means of fastening members (not shown) passing through apertures made in the metal connecting strips 22. The fastening members are, for example, rivets or screws.

In one embodiment, the metal connecting strips 22 are mounted with a sliding clearance j in a direction transverse to the direction of said metal connecting strips 22. The sliding clearance j, shown in FIG. 3, is about 5 mm. This sliding clearance allows the metal connecting strip 22 to move in the plane of the panel 18, 19 in the direction opposed to the support structure 1, when the tank is refrigerated, under the effect of thermal contractions of the secondary sealing membrane 3. Thus the sliding clearance of the metal connecting strips 22 makes it possible to limit the stresses due to thermal contraction. In this embodiment, apertures made in the metal connecting strips 22 for the passage of the fastening members have an oblong shape, the greater length of which extends in a direction transverse to the direction of the metal connecting strips 22 so as to allow sliding in the aforesaid direction.

On either side of the corner structure, the metal plates 16*b*, at the margin of the wall, have edges welded along said metal connecting strips 22, the other edges of said metal plates 16*b* being lap welded to the edges of the adjacent metal plates 16*a*, 16*b*.

Additionally, an angle piece 23, having an L-shaped cross section comprising two perpendicular flanges, extends between a metal connecting strip 22 fastened to the inner surface of a horizontal panel 18 and a metal connecting strip 22 fastened to the inner surface of a vertical panel 22 fastened to the inner surface of a vertical panel 19 so as to ensure the sealing of the secondary sealing membrane 3 in the corner area. The angle piece 23 is, for example, made of Invar®. The angle piece 23 is lap welded onto the edges of the metal plates 16*b* which are welded to the metal connecting strips 22.

Alternatively, it is also possible to weld the angle piece 23 to the metal connecting strips 22 and then to lap weld the adjacent edges of the metal plates 16*b* to the angle piece.

The panels 18, 19 also comprise pins 24 projecting toward the inside of the tank, enabling the primary thermal insulating barrier 4 to be fastened to the secondary thermal insulating barrier 2. The bases of the pins are welded to metal pads 25, fastened to said panels 18, 19 by screws, rivets, stapes or adhesive.

In FIG. 4, it can be seen that the metal connecting strips 22 are formed from juxtaposed discontinuous segments, and the metal pads 25 supporting the pins 24 are arranged, in the axis of said metal connecting strips 22, between two of their adjacent segments.

Figure 6A:
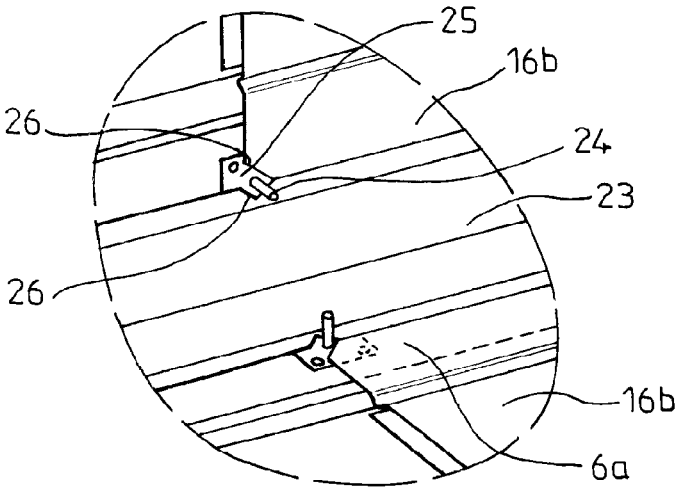
FIGS. 6*a*, 6*b* and 6*c* are detailed views of areas VIa, VIb and VIc, respectively, of FIG. 5.
Figure 6B:
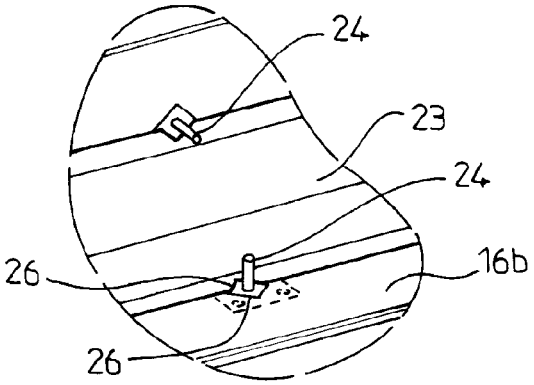

As shown in detail in FIGS. 6*a* and 6*b*, the edges of the angle piece 23 and the edges of the metal plates 16*b*, extending on either side of the corner structure, are provided with cut-outs 26 for the passage of the pins 24. Thus there is no need to perforate the angle piece 23 or the metal plates 16*b* in order to allow the pin 24 to pass through toward the primary thermal insulating barrier 4. To provide continuity of sealing, the angle piece 23 and the metal plates 16*b* are welded to the metal pads 25 at the positions of said cut-outs 26.

With reference to FIG. 4, it can also be seen that the panels 18 and 19 have an identical length 1 and thickness e, while the width L1 of the vertical panel 18 is greater than the width L2 of the horizontal panel 19. In order to provide a corner structure having equal horizontal and vertical dimensions, the width L1 of the horizontal panel 18 is equal to the sum of the width L2 of the vertical panel 19 and the thickness e of said panels 18, 19.

Figure 6C:
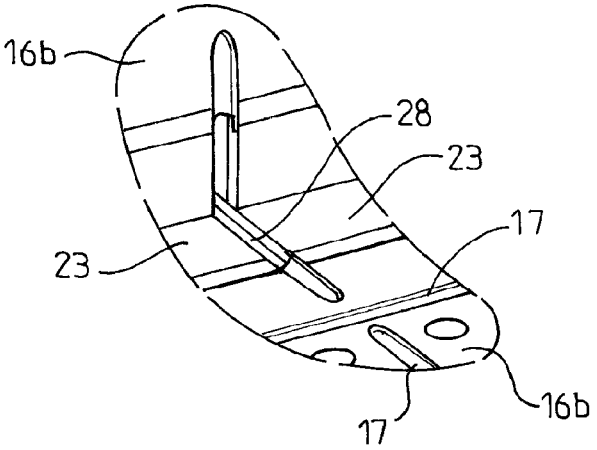
Figure 7:
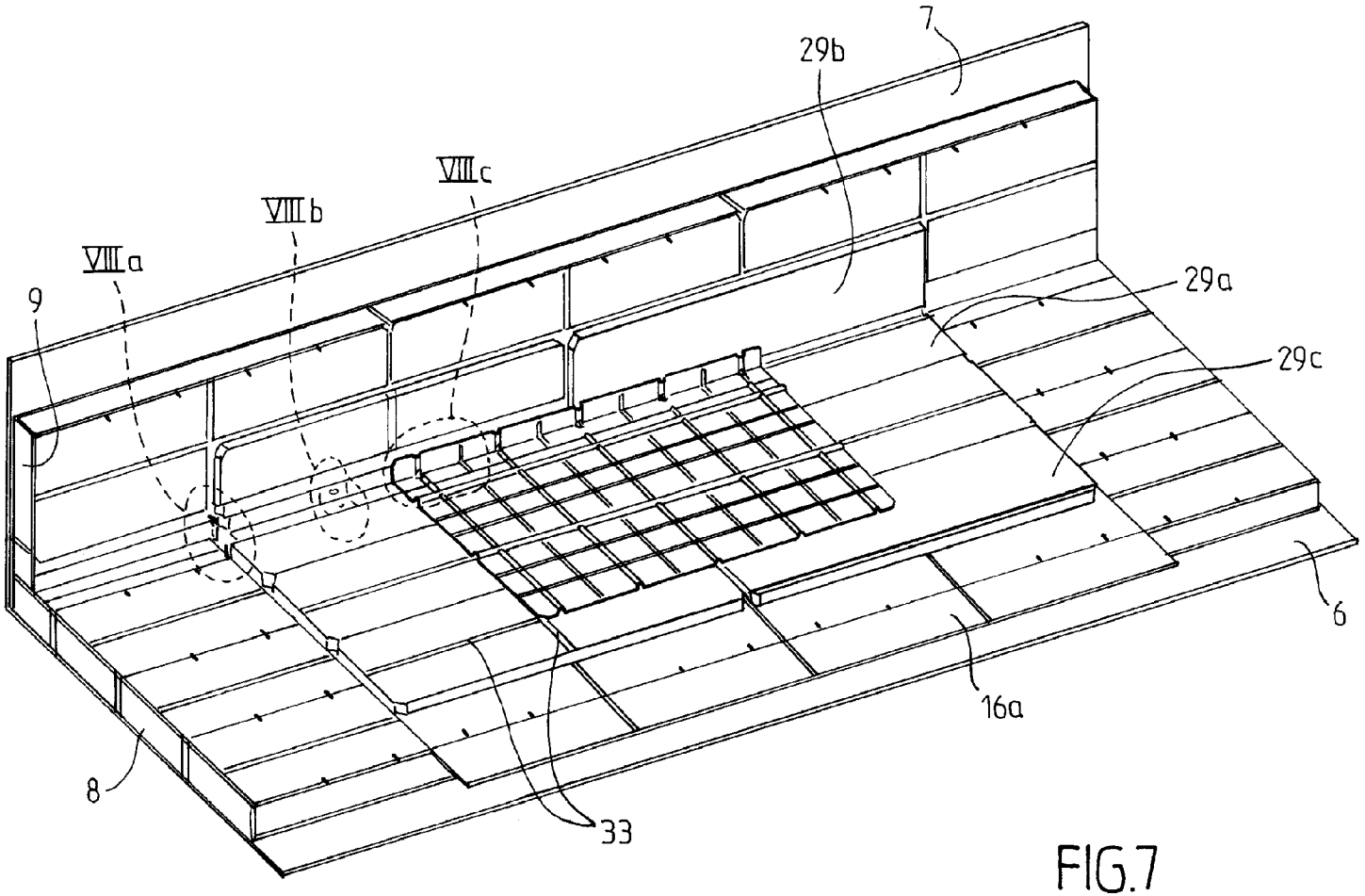
FIG. 7 is a partially cut-away perspective view of a tank having a primary sealing membrane, a primary thermal insulating barrier, a secondary sealing membrane and a secondary thermal insulating barrier.

Additionally, with reference to FIG. 6*c*, it can be seen that a plurality of horizontal panels 18 and vertical panels 19 can be positioned along the intersection between the first and the second wall 6, 7. In this case, in the illustrated embodiment, a gap 28 is formed between the adjacent vertical 18 and horizontal 19 panels and a metal junction piece (not shown) to enable a seal to be provided between two adjacent angle pieces 23. This metal junction piece is substantially L-shaped and comprises a corrugation extending along the gap 28, in the continuation of a corrugation of the adjacent metal plates 16*b*, and projecting into said gap 28. Said junction piece is welded, at two ends of the corrugation, to the edges of the metal plates 16*b*, and has, on either side of said corrugation, flat edges enabling said metal junction piece to be welded to the adjacent angle pieces 23.

FIGS. 7, 8*a*, 8*b* and 8*c* more specifically the arrangement of the primary thermal insulating barrier 4 and the primary sealing membrane 5.

The primary thermal insulating barrier 4 comprises a plurality of insulating panels 29*a*, 29*b*, 29*c* of substantially rectangular parallelepiped shape, covering the secondary sealing membrane 3. The insulating panels 29*a*, 29*b*, 29*c* comprise a layer of insulating polymer foam sandwiched between two rigid plates, namely an inner and an outer plate, made of plywood for example, glued to said foam layer.

Additionally, the insulating panels 29*a*, 29*b*, 29*c* of the primary thermal insulating barrier 4 also have metal connecting strips 33 on their inner surfaces, enabling the primary sealing barrier 5 to be secured by welding.

The secondary sealing membrane 5 is formed by assembling a plurality of metal plates 34 welded to one another along their edges. In the illustrated embodiment, the metal plates 34 comprise two sets of corrugations extending in perpendicular directions. The corrugations of the primary sealing membrane 5 project on the side of the inner surfaces of the metal plates 34. The metal plates 34 are, for example, made of stainless steel sheet or aluminum, shaped by bending or swaging.

The metal plates 34 are staggered relative to the insulating panels 29*a*, 29*b*, 29*c*, each of said metal plates extending across four adjacent insulating panels 29*a*, 29*b*, 29*c*.

Figure 8A:
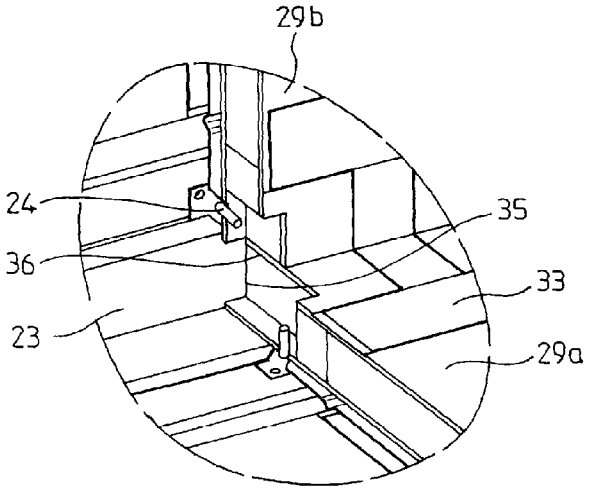
FIGS. 8*a*, 8*b* and 8*c* are detailed views of areas VIIIa, VIIIb and VIIIc, respectively, of FIG. 7.

With reference to FIGS. 1 and 8*a*, we shall now describe the arrangement of the insulating panels 29*a*, 29*b*, which are the horizontal and vertical panels, respectively, of the primary thermal insulating barrier 4, in the corner area. A horizontal panel 29*a* has an outer surface resting against the secondary sealing membrane 3 and a lateral edge 35 resting against the vertical flange of the angle piece 23. A vertical panel 29*b* has an outer surface resting against the secondary sealing membrane 3, while one 36 of its lateral edges rests against the inner surface of the horizontal panel 29*a*.

Figure 8B:
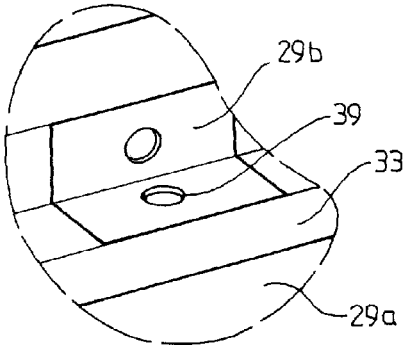
Figure 8C:
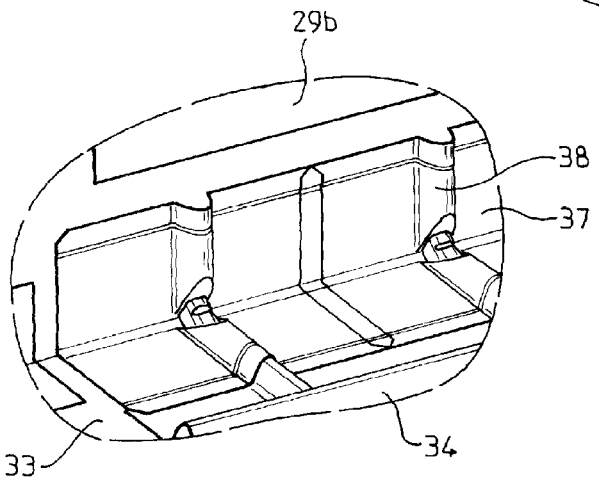

The fastening of the panels 29*a*, 29*b* to the pins 24 fastened to the secondary thermal insulating membrane 2 is shown in FIGS. 8*a* and 8*b*.

In FIG. 8*a*, the insulating foam and the inner rigid plate are set back from the outer rigid plate at the corners of the vertical panels 29*a* and horizontal panels 29*b*. The outer rigid plate also has a cut-out for the passage of the pin 24. Thus a nut (not shown) fitted on the threaded pin 24 can retain the outer rigid plate on the secondary thermal insulating barrier 2.

In FIG. 8*b*, the vertical panels 29*a* and horizontal panels 29*b* have apertures 39 for the passage of pins 24. The aperture has a shoulder (not shown) which can serve as a bearing point for a nut screwed onto a threaded pin 24 introduced through the aperture 39. Thus a nut screwed onto the threaded pin 24 comes to bear against said shoulder so as to fasten the panels 29*a*, 29*b*.

Additionally, the primary sealing membrane 5 has, in the corner area, a corrugated metal angle piece 37, shown in FIG. 9*c*. The corrugated angle piece 37 has corrugations 38, orthogonal to the walls 6, 7, extending in the continuation of one of the series of corrugations of the metal plates 34. The edges of the corrugated angle piece 37 are lap welded to the adjacent edges of the metal plates 34 and to the adjacent edges of the corrugated angle pieces 37. At least two of the edges of the corrugated angle piece are secured to metal connecting strips 33 of the panels 29*a*, 29*b*.

Figure 9:
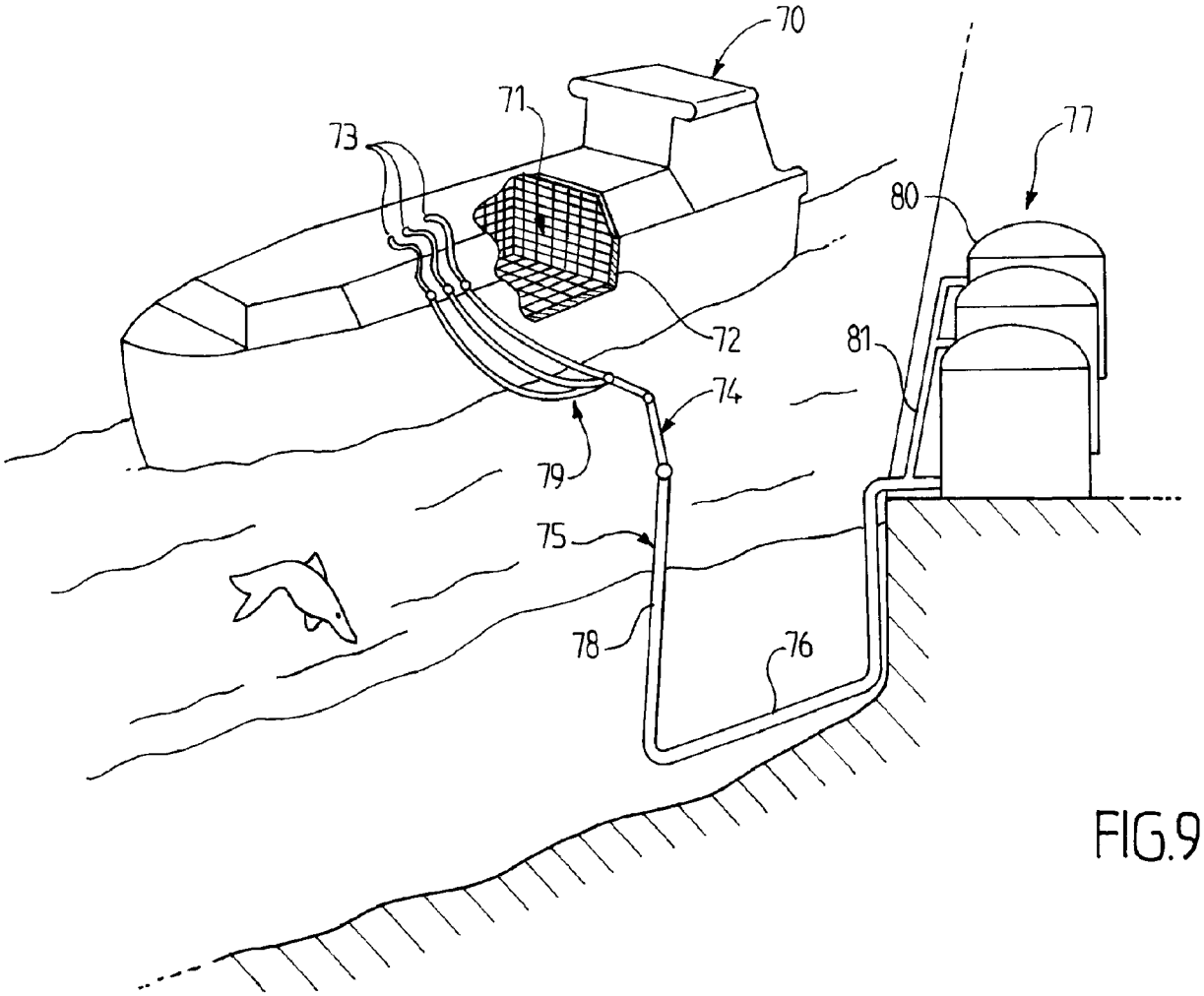
FIG. 9 is a schematic cut-away view of a tank of a natural gas carrier and a terminal for loading and/or unloading this tank.

With reference to FIG. 9, a cut-away view of a gas carrier ship 70 shows a sealed and insulated tank 71 of generally prismatic shape mounted in the double hull 72 of the ship. The wall of the tank 71 comprises a primary sealing barrier intended to be in contact with the LNG contained in the tank, a secondary sealing barrier arranged between the primary sealed barrier and the double hull 72 of the ship, and two insulating barriers arranged, respectively, between the primary sealing barrier and the secondary sealing barrier, and between the secondary sealing barrier and the double hull 72.

In a known way, loading/unloading pipes 73 positioned on the upper deck of the ship can be connected, using appropriate connectors, to a marine or port terminal for transferring a cargo of LNG from or to the tank 71.

FIG. 9 shows an example of a marine terminal comprising a loading and unloading station 75, a submarine pipe 76 and a land-based installation 77. The loading and unloading station 75 is a fixed off-shore installation comprising a movable arm 74 and a tower 78 supporting the movable arm 74. The movable arm 74 carries a bundle of insulated flexible hoses 79 that can be connected to the loading/unloading pipes 73. The movable arm 74, which can be oriented as required, is suitable for all sizes of gas carriers. A connecting pipe which is not shown extends inside the tower 78. The loading and unloading station 75 enables the gas carrier 70 to be loaded and unloaded from or to the land-based installation 77. The latter comprises liquefied gas storage tanks 80 and connecting pipes 81 linked by the submarine pipe 76 to the loading and unloading station 75. The submarine pipe 76 enables the liquefied gas to be transferred between the loading and unloading station 75 and the land-based installation 77 over a long distance, for example 5 km, allowing the gas carrier ship 70 to be kept at a long distance from the shore during the loading and unloading operations.

In order to generate the pressure required for transferring the liquefied gas, pumps on board the ship 70 and/or pumps fitted in the land-based installation 77 and/or pumps fitted in the loading and unloading station 75 are used.

Although the disclosure has been described with reference to particular embodiments, it is evidently not limited in any way to these embodiments, and comprises all the technical equivalents of the means described and their combinations where these fall within the scope of the disclosure.

It should be noted, in particular, that, although the disclosure is described with reference to an embodiment in which the tank has two levels of sealing and thermal insulation, it is by no means limited to this embodiment, but is equally applicable to sealed tanks having only a single level of sealing and thermal insulation.

The use of the verb "to have", "to comprise" or "to include" and any of its conjugated forms does not exclude the presence of elements or steps other than those stated in a claim. The use of the indefinite article "a" or "an" for an element or a step does not exclude the presence of a plurality of such elements or steps unless otherwise specified.

In the claims, any reference symbol in brackets is not to be interpreted as a limitation of the claim.

The invention claimed is:

1. A sealed and thermally insulating tank for storing a fluid, said sealed tank comprising:

an outer support structure;

a thermal insulating barrier retained on the support structure; and a sealing membrane comprising corrugations extending in two perpendicular directions and supported by the thermal insulating barrier, the thermal insulating barrier comprising;

a corner structure positioned at an intersection between a first and a second wall of the support structure, said corner structure comprising a first and a second insulating panel, each having an outer surface positioned facing the support structure, an inner surface provided with a member for securing the sealing membrane, and lateral edges, the first panel having an outer surface resting against the first wall of the support structure and a lateral edge resting against the second wall of the support structure, and the second panel having an outer surface resting against the second wall of the support structure and a lateral edge resting against the inner surface of the first panel; and the tank being characterized in that the first and second panels each comprise, on their inner surface, a member for securing the sealing membrane comprising a metal connecting strip extending along an axis parallel to the intersection between the first and second walls, said sealing membrane comprising metal plates extending on either side of said corner structure and an angle piece extending between a metal connecting strip of the first panel and a metal connecting strip of the second panel, the metal plates having edges welded to the metal connecting strips or to the angle piece, said angle piece having edges welded to the edges of the metal plates welded to said metal connecting strips, or to the metal connecting strips.

2. The tank as claimed in claim 1, wherein the first and second panels each comprise an inner plywood sheet and an outer plywood sheet, forming the inner surface and the outer surface, respectively, of said first and second panels, and a layer of insulating polymer foam sandwiched between said inner and outer plywood sheets.

3. The tank as claimed in claim 2, wherein the lateral edge of the first panel, resting against the second wall, is provided with a plywood sheet.

4. The tank as claimed in claim 3, wherein the thermal insulating barrier is a secondary thermal insulating barrier, and the sealing membrane is a secondary sealing membrane, the tank further comprising a primary thermal insulating barrier and a primary sealing membrane.

5. The sealed tank as claimed in claim 4, wherein the primary thermal insulating barrier comprises, at the intersection between the first and the second wall of the support structure, a corner structure comprising a first and a second primary thermal insulating panel, each having an outer surface positioned facing the secondary sealing membrane, an inner surface provided with a member for securing the primary sealing membrane, and lateral edges, the first primary thermal insulating panel having a lateral edge resting against the second sealing membrane, and the second primary thermal insulating panel having a lateral edge resting against the inner surface of the first primary thermal insulating panel.

6. The tank as claimed in claim 2, wherein the thermal insulating barrier is a secondary thermal insulating barrier, and the sealing membrane is a secondary sealing membrane, the tank further comprising a primary thermal insulating barrier and a primary sealing membrane.

7. The tank as claimed in claim 6, wherein the pins for fastening the primary thermal insulating barrier extend in the axis of one of the metal connecting strips, and the edges of the metal plates welded to the metal connecting strips and/or to the angle piece and the edges of the angle piece welded to the metal connecting strips and/or to edges of the metal plates welded to said metal connecting strips are provided with cut-outs for the passage of the pins for fastening the primary thermal insulating barrier.

8. The sealed tank as claimed in claim 6, wherein the primary thermal insulating barrier comprises, at the intersection between the first and the second wall of the support structure, a corner structure comprising a first and a second primary thermal insulating panel, each having an outer surface positioned facing the secondary sealing membrane, an inner surface provided with a member for securing the primary sealing membrane, and lateral edges, the first primary thermal insulating panel having a lateral edge resting against the second sealing membrane, and the second primary thermal insulating panel having a lateral edge resting against the inner surface of the first primary thermal insulating panel.

9. The tank as claimed in claim 1, wherein the outer surface of the first panel resting against the first wall, the lateral edge of the first panel resting against the second wall, and the outer surface of the second panel resting against the second wall are glued to the support structure.

10. The tank as claimed in claim 9, wherein the thermal insulating barrier is a secondary thermal insulating barrier, and the sealing membrane is a secondary sealing membrane, the tank further comprising a primary thermal insulating barrier and a primary sealing membrane.

11. The tank as claimed in claim 1, wherein a metal connecting strip is retained in a recess formed on the inner surface of the first or second panel, and is fitted in said recess with a sliding clearance j in a direction transverse to the direction of said metal connecting strip, so as to allow the metal connecting strip to move in the plane of the first or the second panel respectively.

12. The tank as claimed in claim 11, wherein the thermal insulating barrier is a secondary thermal insulating barrier, and the sealing membrane is a secondary sealing membrane, the tank further comprising a primary thermal insulating barrier and a primary sealing membrane.

13. The tank as claimed in claim 1, wherein the thermal insulating barrier is a secondary thermal insulating barrier, and the sealing membrane is a secondary sealing membrane, the tank further comprising a primary thermal insulating barrier and a primary sealing membrane.

14. The tank as claimed in claim 13, wherein the first and second panels are fitted with pins for fastening the primary thermal insulating barrier, these pins projecting inward from the inner surfaces of said first and second panels.

15. The tank as claimed in claim 13, wherein the pins for fastening the primary thermal insulating barrier extend in the axis of one of the metal connecting strips, and the edges of the metal plates welded to the metal connecting strips and/or to the angle piece and the edges of the angle piece welded to the metal connecting strips and/or to edges of the metal plates welded to said metal connecting strips are provided with cut-outs for the passage of the pins for fastening the primary thermal insulating barrier.

16. The sealed tank as claimed in claim 13, wherein the primary thermal insulating barrier comprises, at the intersection between the first and the second wall of the support structure, a corner structure comprising a first and a second primary thermal insulating panel, each having an outer surface positioned facing the secondary sealing membrane, an inner surface provided with a member for securing the primary sealing membrane, and lateral edges, the first primary thermal insulating panel having a lateral edge resting against the second sealing membrane, and the second primary thermal insulating panel having a lateral edge resting against the inner surface of the first primary thermal insulating panel.

17. A ship for transporting a fluid, the ship comprising a double hull and a tank as claimed in claim 1, wherein the double hull forms the outer support structure of the tank.

18. A method for loading or unloading a ship as claimed in claim 17, wherein a fluid is conveyed through insulated pipes from or to a floating or land-based storage installation to or from the tank of the ship.

19. A transfer system for a fluid, the system comprising a ship as claimed in claim 17, insulated pipes arranged so as to connect the tank installed in the ship's hull to a floating or land-based storage installation, and a pump for propelling a flow of fluid through the insulated pipes from or to the floating or land-based storage installation to or from the ship's tank.

* * * * *